United States Patent [19]

Khan

[11] Patent Number: 5,033,277

[45] Date of Patent: Jul. 23, 1991

[54] FABRIC SOFTENER DISPENSER FOR AUTOMATIC WASHER

[75] Inventor: Aman U. Khan, Coloma Township, Berrien County, Mich.

[73] Assignee: Whirlpool Corporation, Benton Harbor, Mich.

[21] Appl. No.: 517,150

[22] Filed: May 1, 1990

[51] Int. Cl.[5] ..... D06F 39/02

[52] U.S. Cl. ..... 68/17.00 A

[58] Field of Search ..... 68/17 A

[56] References Cited

U.S. PATENT DOCUMENTS

| | | | |
|---|---|---|---|
| 2,949,025 | 8/1960 | Tingley, Jr. | 68/17 A X |
| 2,953,006 | 9/1960 | Brucken et al. | 68/17 A |
| 2,970,463 | 2/1961 | Johnston | 68/17 A |
| 2,982,120 | 5/1961 | Penensky | 68/17 A X |
| 3,057,181 | 10/1962 | Goodlaxson | 68/17 A X |
| 3,085,417 | 4/1963 | Oles | 68/17 A |
| 3,091,108 | 5/1963 | Martin et al. | 68/17 A |
| 3,290,908 | 12/1966 | McAllister | 68/17 A |
| 3,596,480 | 8/1971 | Douglas | 68/17 A |
| 3,742,242 | 4/1973 | Davis | 68/17 A |
| 4,154,069 | 5/1979 | Lipfert et al. | 68/17 A |
| 4,656,844 | 4/1987 | Mulder et al. | 68/17 A |
| 4,691,538 | 9/1987 | Shikamori et al. | 68/17 A X |

FOREIGN PATENT DOCUMENTS 0016666 4/1987 Japan ..... 68/17 A

*Primary Examiner*—Philip R. Coe

*Attorney, Agent, or Firm*—Price Heneveld Cooper Dewitt & Litton

[57] ABSTRACT

The specification discloses a dispenser for liquid additives for use in an automatic clothes washer, particularly of the type having an upright agitator with hollow tubular internal portions. The dispenser structure is adapted to be mounted wholly within the hollow agitator interior, and comprises two separate but interconnected stages which are coordinated to complete dispensing operation only after predetermined amounts of agitator rotation at or above a predetermined spin velocity. The first stage of the dispenser apparatus is preferably of the centrifugal type, including a rotating cup which expels the liquid additive by the effects of centrifugal force, and the second stage, which receives the liquid expelled from the first stage, is preferably a siphon device arranged so that it can only be primed and actuated when a full charge of additive has been received from the first stage. The top of the siphon tube in the second stage is preferably disposed near the center of a rotatable cup, whereby siphon operation is also dependent upon and related to agitator rotational speed.

25 Claims, 6 Drawing Sheets

T-7

T-6

T-5

FABRIC SOFTENER DISPENSER FOR AUTOMATIC WASHER

BACKGROUND OF THE INVENTION

1. Field of the Invention

This invention relates generally to automatic washers and means for dispensing liquid inside automatic washers at designated points during their programmed cycles of operation. More particularly still, the invention relates to means for dispensing liquid wash additives, e.g., fabric softeners or blueing, in automatic washers particularly those of the type which utilize intermittent or progressively staged acceleration of the agitator during spin cycles, and especially to dispensing means for such applications which provide for automatic dispensing operation at a desired point following the attainment of a predetermined spin velocity for a predetermined time over a course of both acceleration and deceleration.

2. Prior Developments and Previous Practices

A number of different types of dispensers for liquids in automated washing devices have been used heretofore, among which are such differing approaches as electromechanical devices which require programmed remote actuation, as well as a number of what are essentially self-actuated devices of a primarily mechanical nature which respond to various conditions during the operation of the washing machine, often a predetermined agitator speed threshold, to dispense liquids at some given point during the washing process without the need for external control devices.

Centrifugally actuated dispensers are frequently encountered in the latter group, and a good example of such a device is that shown in U.S. Pat. No. 4,656,844, which is commonly owned herewith and which is hereby incorporated by reference. As discussed in that patent, centrifugal dispensers typically employ a cup-like or other such receptacle which is usually either mounted upon the agitator or secured to the basket of the washing machine, such that liquid additive contained within the receptacle is forced upward and outward along the receptacle walls as the rotational speed of the agitator or basket increases, typically during a spin cycle, until the point is reached where the additive escapes over the edge of the receptacle. When the basket slows down, the fluid works its way to the wash basket to contact the wash load.

Various other forms of centrifugal liquid dispensers have also been proposed, as have various other types of devices based upon other and different physical principles, e.g., siphons, etc. Often, such other types of liquid dispensers are also related to or dependent upon agitator spin speed, as is true for example of the devices shown in U.S. Pat. Nos. 3,057,181 and 4,154,069, the first of which utilizes centrifugal force produced by the spinning agitator to load o prime the siphon tube while the latter uses an impact tube coupled to the agitator so that motion of the latter moves the impact tube through the liquid additive to be dispensed and causes the liquid to enter the impact tube and then move onward into the siphon. Many other particular approaches have been proposed, including the use of float-actuated dispensers, such as that shown in U.S. Pat. No. 3,724,242.

In order to achieve delayed dispensing at some later point during the washer operation, some dispensers have been proposed which utilize a pair or more of ganged or cascaded release stages. Thus, for example, U.S. Pat. No. 3,620,054 discloses a two-part centrifugal liquid dispenser which includes an inner-cup portion as well as an outer-cup or other such housing. Another different such type of device is shown in U.S. Pat. No. 4,691,538, which shows a staged pair of centrifugal dispenser sections disposed one above the other along the agitator axis. Somewhat similarly, the aforementioned U.S. Pat. No. 3,724,242 includes, with the float-actuated dispenser section already noted, a first centrifugally-operated dispenser section which discharges into the float-actuated dispenser section. To some extent, the aforementioned U.S. Pat. No. 4,154,069 might be considered a two-stage device, since the described impact tube structure which in effect loads the siphon could perhaps be considered a first stage and the siphon considered a second stage; indeed, this patent refers to the impact tube stage stage as a "timing means".

Notwithstanding the relatively extensive prior development of liquid-dispensing apparatus for automated washing machines, the continuing development of new and improved such machines brings about new circumstances and conditions which prior developments do not address and for which they do not provide solutions. In addition, continuing refinement of washer operation and sequences, together with advances and changes in detergents and additives, including for example fabric softeners, result in the apprehension of new and/or changed perceptions of the optimum time and conditions for dispensing wash additives.

Accordingly, many present-day automatic washers utilize selected and varying, non-constant agitator spin speeds, including "sub-interval" spin cycles. Furthermore, many such present-day washers utilize pulse actuation (energization) of the agitator drive motor. For example, reference is made to commonly-owned U.S. Pat. No. 4,779,431, which discloses and depicts particular details and aspects of such actuation, in accordance with which the agitator drive motor is energized by a series of electrical pulses whose duration and/or repetition rate is selected to gradually bring the agitator up to a desired spin speed over a period of time. With this type of actuation, the agitator actually undergoes an alternating sequence of positive and negative acceleration (i.e., deceleration), such that the resultant velocity profile comprises an alternating sequence along an increasing slope until the desired ultimate speed level is finally reached. As will be readily understood upon contemplation, such a velocity profile has an immediate and profound effect on centrifugally-actuated additive release mechanisms and may well result in their malfunction.

Accordingly, the need exists for a liquid additive dispenser for automatic washers which is readily adapted to washers with non-constant spin speeds and which, in addition, are preferably of a primarily or exclusively mechanical nature, which are self-actuating, and which have no moving parts which may produce undesired performance variations as well as malfunction and, ultimately, early failure. Furthermore, a need exists for a liquid wash additive dispenser which will operate to dispense the additive at a specific time near the end of the wash cycle, following certain increases and decreases in agitator speed, such that an optimum quantity of the additive (e.g., fabric softener) will remain in the wash load for optimal benefit during the subsequent drying cycle.

SUMMARY OF THE INVENTION

The present invention has for its major objectives and advantages the provision of a new type of liquid additive dispenser which effectively satisfies all of the aforementioned present-day needs and which is, as desired, without moving parts and does not require any external actuation, such as by connection to the washer control system. The novel dispenser in accordance herewith is entirely self-contained and is actuated solely by the progressive performance of the automated wash cycle programmed into the washer, to dispense additives after the spin cycle and following various increases and decreases in agitator speed, whereby dispensing takes place at a particular desired time near the end of the wash cycle, whereby an optimum quantity of the additive (e.g., fabric softener) remains in the wash load during the subsequent drying cycle to provide its maximum benefit from the additive.

Furthermore, the novel dispenser system disclosed herein function in accordance with a new and advantageous operational concept, by which the system is self-activating as a function of multiple conditions which are in effect integrated to reach the point of actuation, i.e., agitator speed in excess of a minimum over a cummulative length of time which may comprise several different sequences occurring at different points in time.

More particularly, the dispenser in accordance herewith comprises an assembly which is located wholly within the washer agitator, and which includes a pair of different dispensers which are axially staged for successive and interrelated operation. More particularly still, the dispenser in accordance herewith preferably comprises a first centrifugally operated dispensing stage coupled to a second siphon-operated stage, whereby additive dispensing into the wash does not occur until a predetermined sequence of washer operation has taken place and a particular point during the wash cycle has been reached. Thus, the dispenser is relatively uncomplicated mechanically, is entirely mechanical in nature, has no moving parts, is self-actuating, is directly and easily accessible during the operation of the washer, and furthermore, is of a nature providing a self-cleaning function, which occurs during subsequent parts of the wash cycle. The novel dispenser in accordance herewith is thus of very high reliability while at the same time providing significant cost advantages in manufacture and assembly.

The foregoing attributes, objectives, and advantages of the invention will become more apparent following consideration of the ensuing specification and drawings which set forth a preferred embodiment thereof.

DESCRIPTION OF PREFERRED EMBODIMENTS

Figure 1:
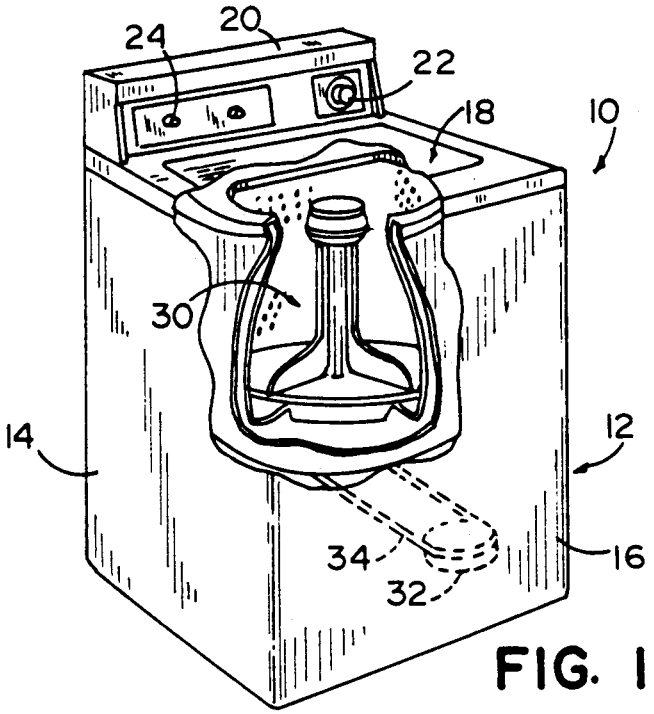
FIG. 1 is a frontal perspective view of an automatic washing machine of the type in which the invention may be advantageously utilized, with portions in cutaway to reveal certain internal components.

Referring now in more detail to the drawings, a preferred form of the additive dispenser in accordance with the invention is intended for utilization in an automatic washer such as that shown generally in FIG. 1 and designated there by the numeral 10. As so depicted, the washer 10 is generally of a known type and includes a generally rectangular cabinet 12, having sides 14, 16, etc., for housing the operational parts of the machine, together with a hinged top 18 through which the user may load and unload articles to be washed, as well as adding washing substances, including fabric softeners and other such additives. On the top of the cabinet 12, at the rear, is a control console 20 which contains the operating controls for the washer, represented by actuation knobs 22 and 24, generally of a familiar nature and including cycle and wash-type selectors, etc.

Housed within the cabinet 12 are such familiar major subassemblies or units as a wash tub 26, a basket 28 (which is usually perforate in nature), and an agitator 30. In the bottom of the cabinet are housed the drive motor 32, and some form of desired transmission 34, by which the agitator 30, and typically the basket 28 as well, are coupled to the motor 32, for rotation thereby. As will be understood, the tub 26, wash basket 28, and agitator structure 30 are concentrically mounted along a common central axis, and the basket and agitator are typically mounted for separate drive motion from the motor and transmission 32, 34, so that they may be selectively rotated either oppositely or in unison to accomplish the desired wash cycle performance.

Figure 2:
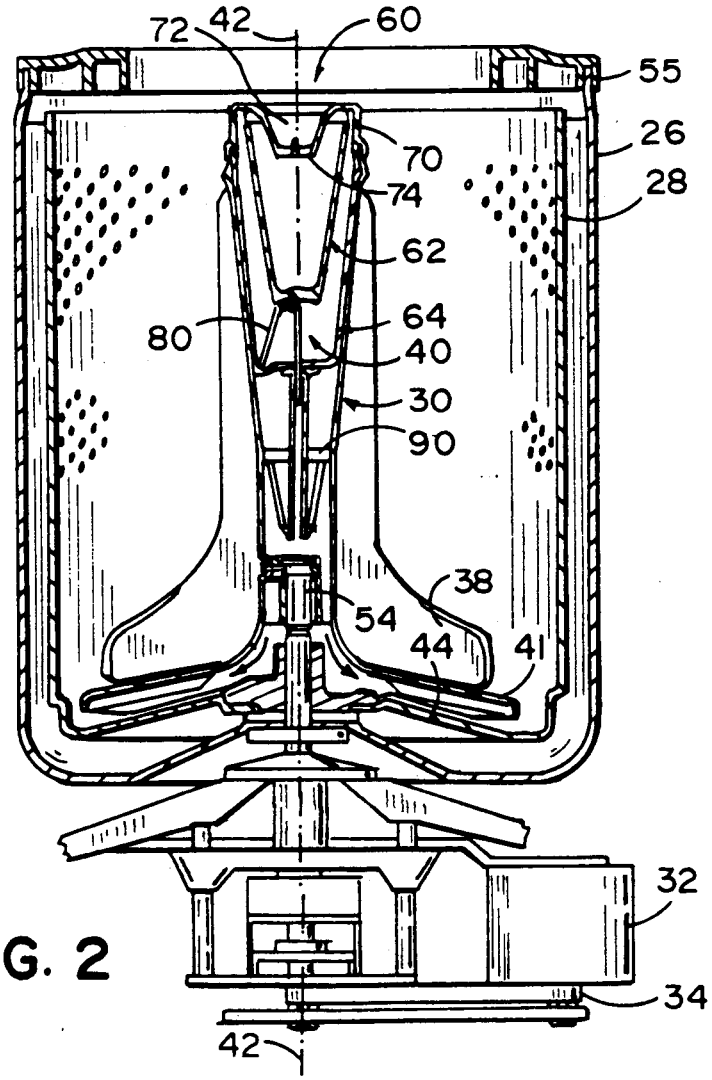
FIG. 2 is an enlarged fragmentary central sectional elevation of the washer shown in FIG. 1, generally showing an agitator embodying a dispenser in accordance herewith, together with agitator drive means.
Figure 3:
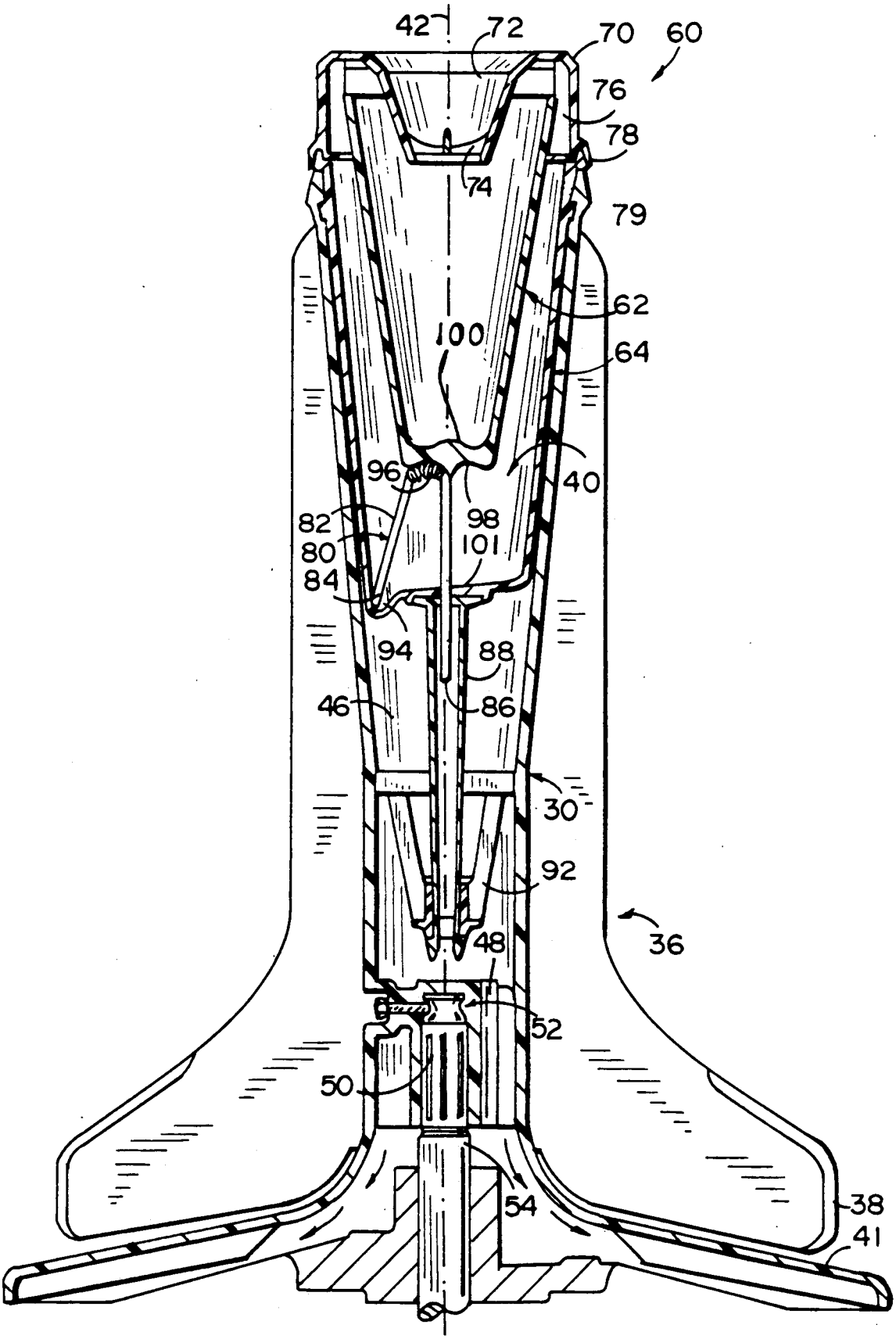
FIG. 3 is a further enlarged sectional elevation of the agitator and dispenser shown in FIG. 2, showing details thereof.

The agitator structure 30, shown generally in FIG. 1, is illustrated in more detail in FIGS. 2 and 3, where it will be seen to include a plurality of spaced, vertically-oriented vanes 36 for moving a load of wash placed in the basket 28, so as to accomplish the desired washing action. As further shown, the vanes 36 flare outwardly at their bottom extremities 38 to better accomplish this purpose, and have their lowermost edges in closely spaced relation to an angularly flared, generally annular apron or plate 41, which is concentrically disposed with respect to the remainder of the agitator structure along the rotational drive axis 42. The underside of apron 41 is disposed directly adjacent the lower extremity 44 (see FIG. 2) of the wash basket 28, sloping outwardly and downwardly toward the cylindrical sides of the latter, all in a known manner.

As further illustrated in FIGS. 2 and 3, the interior of the agitator 30 essentially defines a hollow tube 46, which contains a centrally-disposed mounting hub 48 near its lowermost extremity that has a splined interior 50 for receiving a complementary spline on the upper extremity 52 of the agitator drive shaft 54, all in a generally known manner. Further, the additive dispenser 60 in accordance with the invention is, in the preferred embodiment, carried on and in the hollow uppermost extremity of the agitator 30.

Figure 4:
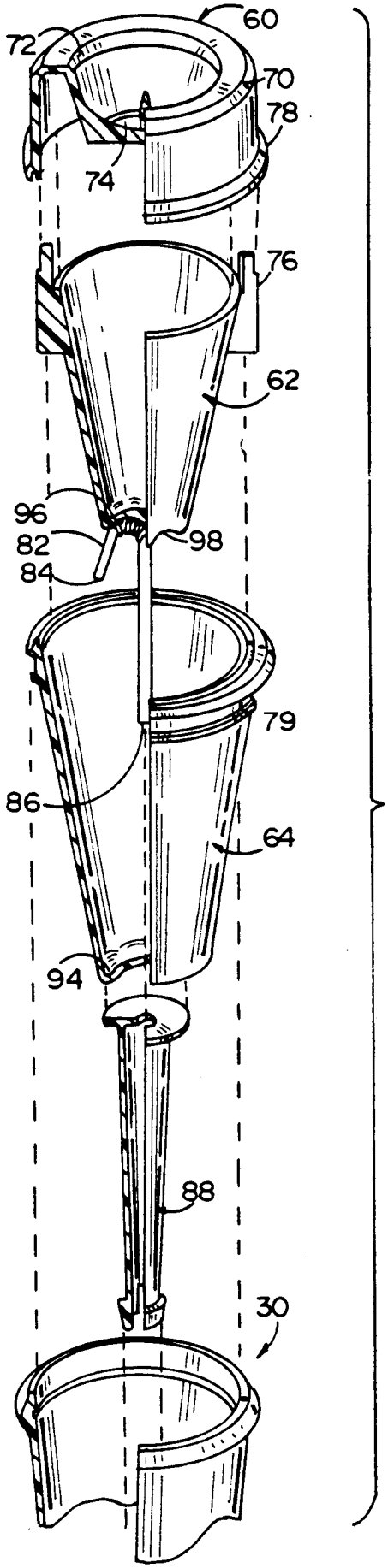
FIG. 4 is an exploded perspective view showing the dispenser structure.

More particularly, the dispenser 60 basically comprises a pair of coaxially disposed cup-like additive receptacles 62 and 64 (FIGS. 3 and 4) which are partially telescoped with one another and with the top of the agitator tube 46, as illustrated. The lower such receptacle 64 is nested directly within the hollow upper extremity of the agitator interior 46, and the upper receptacle 62 is disposed coaxially within receptacle 64, with the bottom extremity of upper receptacle 62 spaced above that of receptacle 64 to provide an intervening compartment 40 comprising a second stage of the dispenser apparatus, as explained more fully below. The upper extremities of receptacles 62 and 64 are interconnected by a toroidally shaped collar 70 whose inner periphery defines an inlet pouring spout 72, in which a strainer basket 74 is preferably mounted to prevent entry of undesired foreign objects while at the same time allowing liquids to pass readily through into the interior of dispenser 62. A plurality of mutually spaced, annularly-arranged inner spacers 76 is preferably disposed between the upper extremity of receptacle 62 and the outer periphery of the collar 70, whose lower annular extremity 78 is spin welded to the top of the receptacle 64. The uppermost extremity of receptacle 64 preferably fits snugly inside the upper extremity of the agitator tube, and is seated therein by an annular ring 79.

The aforementioned intervening compartment 40 comprises a second stage of the dispenser in accordance herewith, and houses a siphon tube 82, such second stage preferably being a siphon stage. As illustrated, siphon tube 82 preferably has a first opening or end extremity 84 positioned radially outward from rotational axis 42 and a second opening or end 86 which is disposed substantially along the axis 42 and within a downwardly-extending discharge tube 88 that supports a lint filter 92.

The first opening or end 84 of siphon tube 82 is preferably disposed within a shallow, downwardly dished concavity 94 formed in the bottom of the second receptacle 64. Opening 84 comprises the siphon inlet, and is disposed above the second opening 86, which comprises the siphon outlet. Siphon tube 82 defines an upstanding loop or reverse bend 96 which extends between and above the two openings 84 and 86. Preferably, the arcuate upper extremity of bend 96 is formed within a corrugated section of the tube (as shown in FIG. 3), by which the latter may be readily bent into the smooth inverted U-shape shown without cross-sectional deformation. The bend 96 is preferably received within a toroidally-shaped recess 98 forming the bottom surface of the first receptacle 62, whereby the dispenser structure is integrated and the siphon tube retained steadily in position. The inside bottom surface 100 of receptacle 62 is preferably made smoothly convex. As will be understood, the hollow interior 46 of agitator structure 30 communicates downwardly into the bottom extremity of wash basket 28, mounting hub 48 being somewhat spider-like in nature, or otherwise having downwardly extending passages through it, such that fluid travelling downwardly through the interior of the discharge tube 88 may enter the bottom of the wash basket by passing through the open annular upper extremity of agitator base portion or skirt 41.

In a structural sense, the outlet or discharge tube 88 is secured in place to the bottom of the second receptacle 64, for example by spin-welding. The lint filter 92 may be snap-fitted onto the lower extremity of discharge tube 88 and merely positioned within hollow agitator tube 46 upon insertion of the dispenser assembly 64. The lower, outlet portion of siphon tube 82 is preferably firmly seated within a plug seal 102 at the base of second receptacle 64, and the upper bend 96 may be adhesively or otherwise secured in place within the toroidal recess 98 on the underside of the upper additive receptacle 62, whose uppermost extremity may be secured to the inner spacers 76, and, in turn, to the upper collar 70 which comprises the inlet to the dispenser apparatus.

Figure 5:
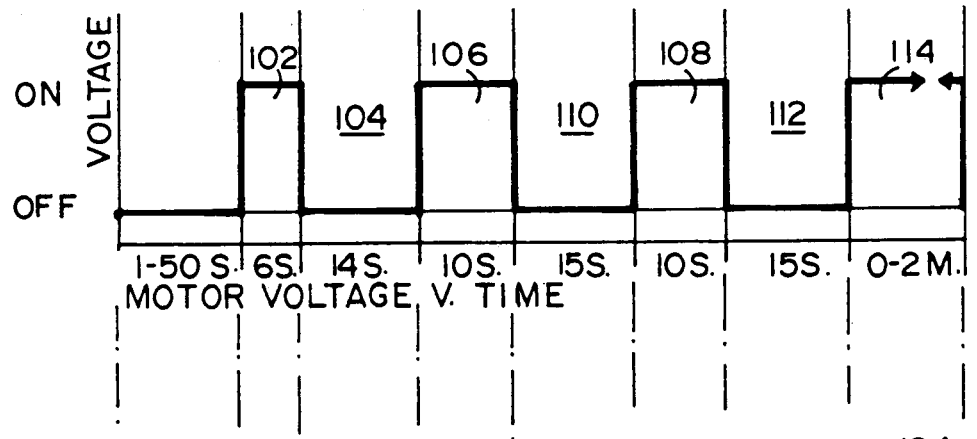
FIG. 5 is a graphical representation in the form of a timing chart showing illustrative pulse-form motor excitation.

As previously indicated, the dispenser apparatus in accordance with the invention is particularly useful in automatic washers having multiple and varied spin cycles, particularly those employing "sub-interval" spin operation and, as a general matter, in washers employing modulated-pulse agitator motor drive excitation, of the general type disclosed and described in U.S. Pat. No. 4,779,431. For convenience, and to facilitate a more rapid understanding of such excitation, FIG. 5 provided herewith illustrates a typical start-up sequence of such pulses, in which an initial pulse 102 of relatively short duration is followed by an intervening off time 104 and then a ensuing pair 106, 108 of longer-duration "on" pulses 106, 108 which are separated from one another by substantially equal spacings 110, 112 that are longer in duration than the aforementioned spacing, or off time, 104. Following pulse 108 and spacing 112, a steady-state "on" pulse 114 of variable duration occurs, whose on time is sufficient to maintain the maximum agitator speed generally constant.

Figure 6:
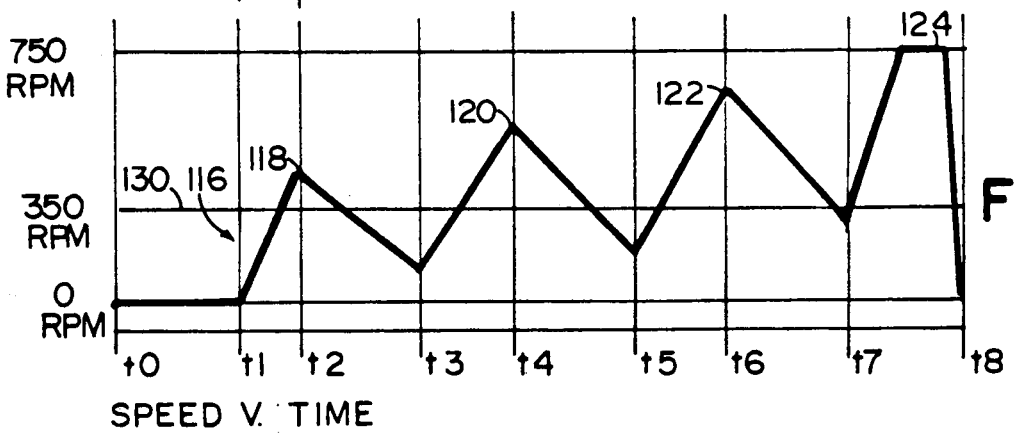
FIG. 6 is a graphical representation coordinated to FIG. 5 and showing an illustrative agitator velocity profile based upon motor excitation in accordance with FIG. 5.

FIG. 6, shown in correlated juxtaposed position to FIG. 5, illustrates the velocity profile which results from the modulated-pulse excitation shown in FIG. 5. As thus illustrated, the velocity profile 116, comprising a speed versus time graph, has a series of sawtooth-like velocity increases 118, 120, and 122, followed by a flattened, continuous level 124. These speed changes correspond to and result from application of the drive pulses 102, 106, 108, and 114, respectively. In this manner, the agitator is brought from a condition of standstill, extending from times $t_0$ and $t_1$ to final velocity 124 occurring after time $t_7$, and slightly before time $t_8$, times $t_2$–$t_6$ inclusive corresponding to the trailing edge of excitation pulses 102, 106, and 108, respectively, and time $t_7$ corresponding generally to the leading edge of excitation pulse 114. The sudden and continuous drop in speed which commences just prior to time $t_8$ represents agitator deceleration and ultimate stopping, resulting from the cessation of drive pulses.

In general, the dispenser in accordance herewith operates by in effect integrating the duration of time periods during which agitator speed exceeds a predetermined minimum or threshold level, represented for purposes of illustration by the threshold line 130 in FIG. 6. Further, the dispenser operates to produce the ultimate release of additive into the wash upon the occurrence of a predetermined agitator deceleration following the achievement of a predetermined agitator speed-time integration as just noted. More specifically stated, the first stage dispenser represented by receptacle 62 operates by centrifugally displacing and ejecting a predetermined charge of additive after a predetermined cumulative amount of time during which agitator speed exceeds a threshold level, which may occur during a single period on any combination of lesser periods. The additive which is so displaced through centrifugal force is received in the second stage of the dispenser, represented by receptacle 64. The priming and operation of siphon 80 which requires accumulation in receptacle 64 of substantially the entire predetermined charge initially placed in receptacle 62, as a minimum, together with a predetermined degree of agitator speed reduction.

Figures 7, 8, 9, 10:
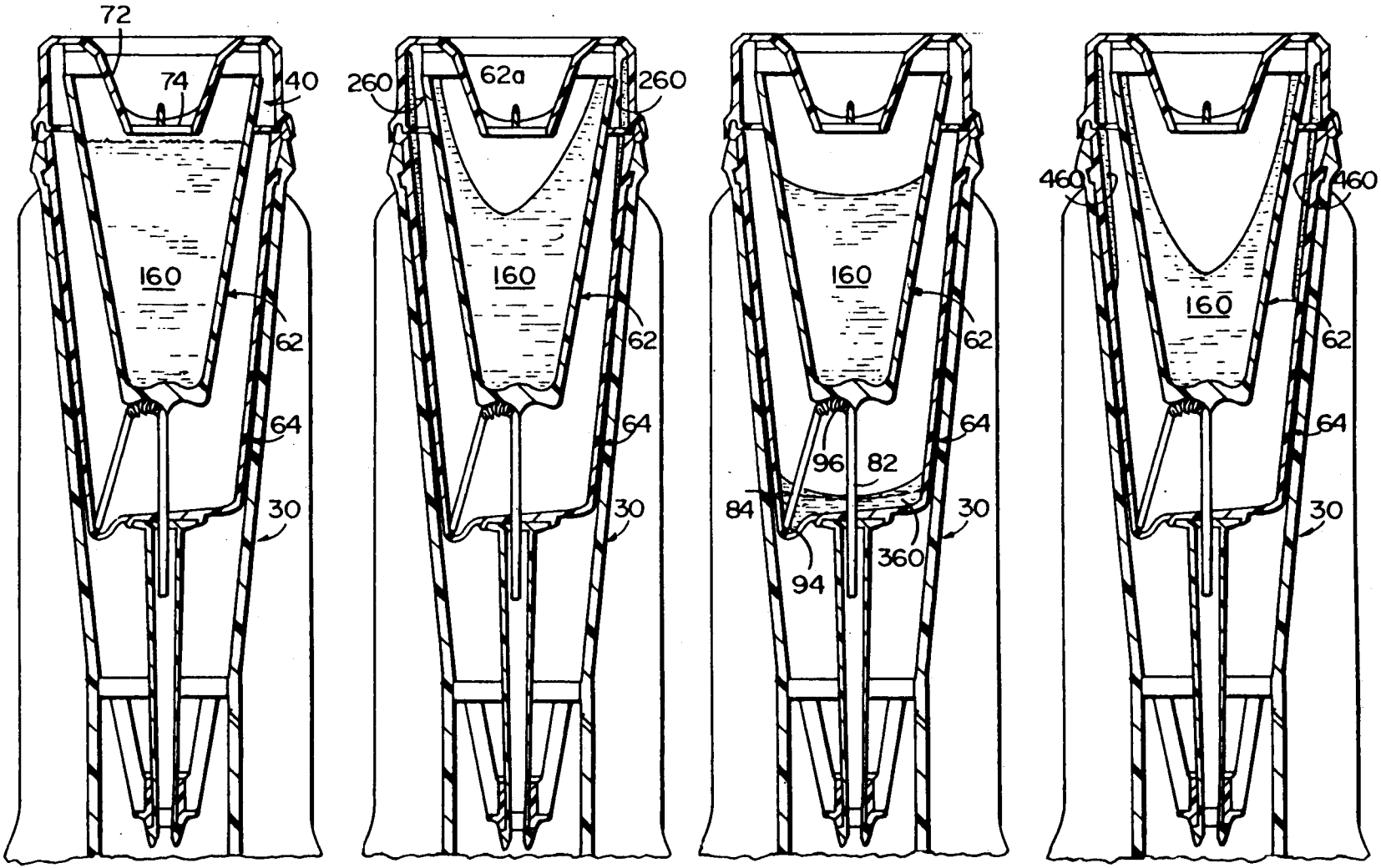
FIGS. 7–13 are a series of simplified, fragmentary sectional views of the agitator and dispenser as shown in FIG. 3, together constituting a schematic representation of dispenser operation during the washing sequence.
Figure 13:
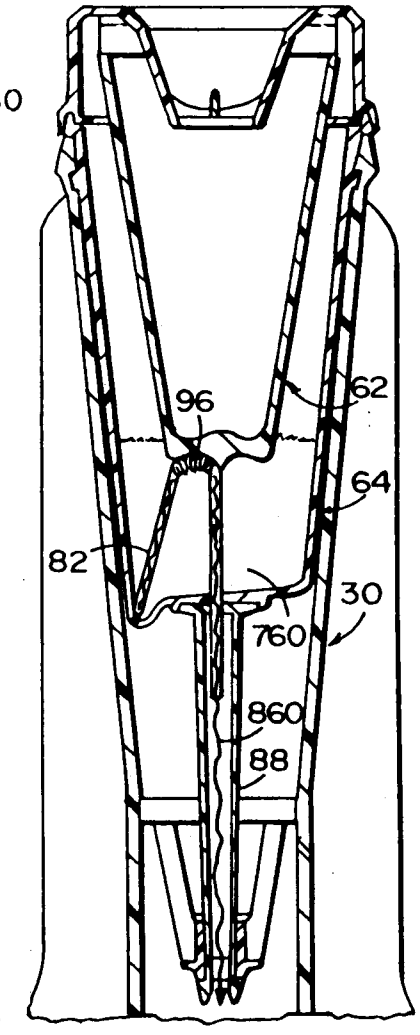

This sequence of events is illustrated in FIGS. 7-13 inclusive, and may readily be appreciated by comparing one figure to another in that sequence. More particularly, as shown in FIG. 7 (the general condition at time $t_1$), the upper additive receptacle 62 has been filled with the desired quantity of additive 160, shown for illustration as substantially filling the volume in the cup-like receptacle 62 between its inlet strainer or filter 74 and rounded bottom extremity 100, having been poured in through the open inlet spout 72. Since cup 62 has imperforate walls throughout the area initially occupied by the additive 160, the latter will stay in place throughout washer operation involving agitator speeds less than predetermined threshold amount, as represented by the threshold line 130 in FIG. 6.

Accordingly, the additive 160 stays in the position shown in FIG. 7 throughout the initial wash action, involving lower agitator speeds, until the washer program commences spin activity, which may be increments of sub-interval spin or otherwise. In any event, as the drive motor 32 receives the pulse excitation previously described and illustrated in FIG. 5, it commences the course of acceleration illustrated by the velocity profile 116 in FIG. 6, and, as shown in the latter figure, at and just prior to the time $t_2$ agitator spin speed begins to exceed the preselected threshold level 130. At this point, the additive 160 has come to take the form shown in FIG. 8, in which a vortex has formed in the upper portion of the additive 160 and its upper surface defines a pronounced concavity 162 due to the effects of centrifugal force. Under these conditions, a first amount of additive 260 exits the upper receptacle 62 by creeping over its upper edge $62_a$. The additive 260 which has departed the first or upper receptacle 62 migrates to the adjacent upper wall of the lower receptacle 64, where it is held in place by centrifugal force so long as the angular velocity of the agitator exceeds the threshold 130. As agitator Velocity decreases during the interval $t_2$–$t_3$ following excitation pulse 102 and preceding the next excitation commencing at time $t_3$, spin velocity decreases below threshold 130 and, as a result, the expelled quantity of additive 260 descends to the bottom of the second stage dispenser 64, where it is designated by the numeral 360. As illustrated, this amount of additive occupies only a relatively small amount of the total volume in lower cup 64, filling the well 94 and covering the siphon inlet 84 but being far below the top of the arch 96 at the top of siphon. Of course, the volume of additive 160 remaining in the upper receptacle 62 is now significantly less than it was previously, and its upper surface lies well below the strainer 74.

The procedure just discussed in connection with FIGS. 7, 8, and 9 continues as agitator speed increases in accordance with velocity profile 116, in response to successive pulses of drive motor excitation. Thus, at times $t_4$ and $t_6$, represented by FIGS. 10 and 12, respectively, the vortex appearing in the top of the first receptacle 62 grows progressively deeper as agitator velocity increases and greater amounts of liquid 460, 660 are expelled outwardly and held by centrifugal force against the uppermost walls of the second-stage dispenser 64, and against the inside wall of the collar 70 at the top thereof, within spaces located between the reinforcement spacers.

Figure 12:
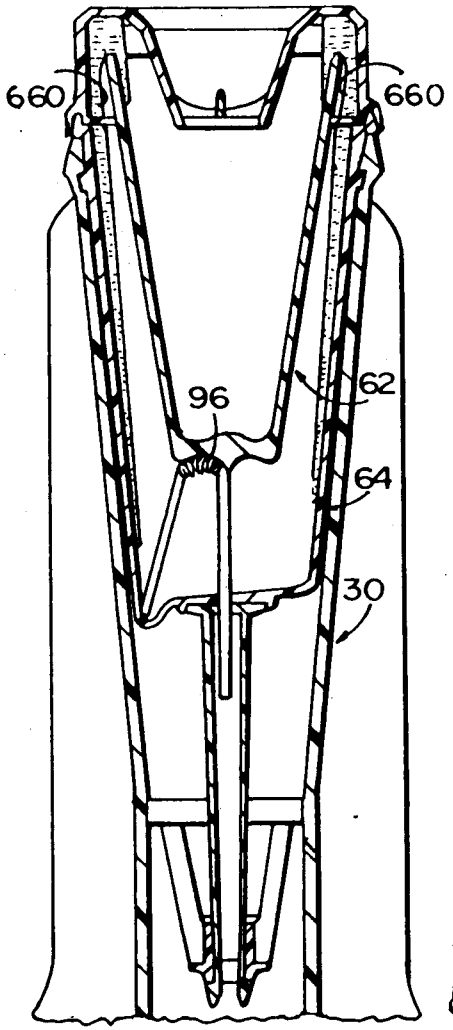
Figure 11:
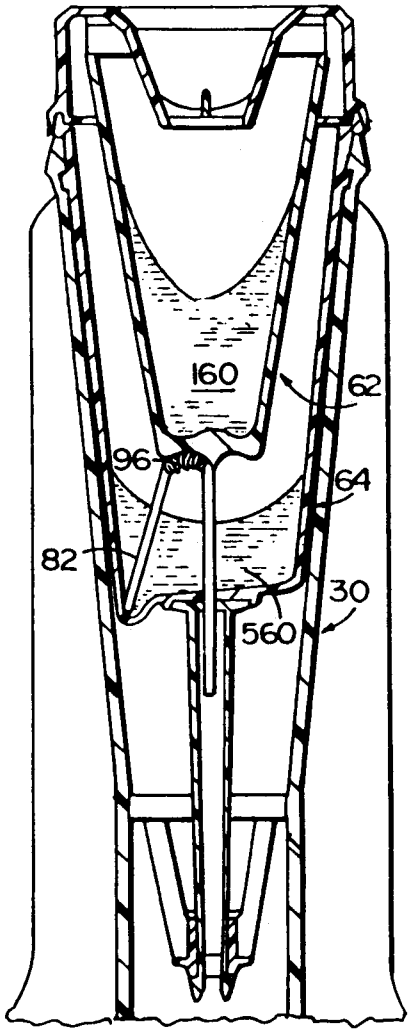

During the final periods of acceleration, brought about by drive pulses 114 (FIG. 7) and occurring at times $t_5$ and $t_7$, the ever-increasing angular velocity (spin rate) and corresponding high levels of centrifugal force ultimately brings the wash additive to the position shown in FIG. 12, wherein the additive is designated by the numeral 660. Under these circumstances, the entire charge of additive initially present in upper dispenser 62 is entirely disposed in a broad tubular vortex held high against the inside surface of the dispenser, with both dispenser cups 62 and 64 being emptied of the liquid. Following a predetermined period of maximum spin rate 124 (FIG. 5), occurring generally during the time $t_7$–$t_8$, drive excitation is terminated and agitator deceleration commences. When angular velocity decreases, the quantity of additive 660 is gradually drawn downwardly by the force of gravity into the lower extremity of the second stage dispenser 64 (FIG. 13) wherein it is designated by the numeral 760. As illustrated, when rotation stops, the quantity of additive 760 is now sufficient to cover the top of siphon tube 82, including the upper bend or arch 96 thereof. Accordingly, the siphon is primed and siphon action commences, whereupon the volume of additive 760 is drawn through the siphon tube 82 and discharged from its lower opening 86, from where it falls by gravity downwardly through the discharge tube 88, as illustrated by numeral 860. Once such siphon action commences, it continues until the entire volume of additive 760 has been drawn out of the second stage dispenser 64, since the presence of the concave well 94 in the bottom of the lower cup 64 will serve to collect substantially all of the minute quantities of additive from the very bottom on cup 64 and concentrate them in one area for removal by the siphon. Of course, once the additive has been discharged downwardly through the various openings provided in the mounting hub 48 and through the belled end of the agitator skirt 41, in the manner shown by the arrows in FIG. 3. From there, the additive works its way downwardly along the bottom surface of the wash basket 28, where it may mix with any water in the area, as may be present during an ensuing rinse cycle, or otherwise comes into contact with the wash load.

It will now be apparent that the novel dispenser in accordance with the invention provides a compound, staged dispensing action which requires a particular sequence of velocity and time before ultimately discharging the additive. Thus, depending upon specific configurations and design parameters which may be utilized, particular points in the wash cycle may be selected for discharge of additive, in the preferred embodiment illustrated and discussed such point being near the end of the wash cycle, after various changes in agitator speed, including "sub-interval" spins. Thus, the response of the present dispenser is complex in nature and, in essence, is based upon two mutually opposite conditions, i.e., progressive summing or integration of agitator spin time velocity exceeds a predetermined minimum threshold, until a predetermined total time unit has occurred, followed by a predetermined minimal period of agitator spin speeds below the aforementioned threshold level, under which condition the final tubular vortex of additive held against the outer periphery of the dispenser wall may progress downwardly and fill the siphon channel to thereby prime and actuate the siphon. Thus, the dispenser will only empty its contents into the wash after a particular combination of predetermined events have occurred, and premature emptying cannot take place since the siphon stage cannot operate until the full charge of additive is present in it and the agitator rotation has stopped. At the same time, by use of the siphon principle in the second stage dispenser, once the ultimate dispensing action commences it carries on without interruption until the full charge of additive is discharged.

As a final aspect of the novel dispenser apparatus, it is to be noted that the dispenser is be largely self-cleaning, in that any final rinses, or the initial fill upon washing the next load of clothes, will fill the tub 26, to a level at least as high as the lower dispenser receptacle 64, and thereby flood the hollow interior 46 of the agitator. When this occurs, water will pass upward through siphon tube 82 and flood the interior of receptacle 64, cleaning the same of all remnant quantities of the additive utilized in the previous washing operation. Of course, this is discharged back down through siphon tube 88, in the same general manner as was true of the additive dispensed earlier, at the end of the wash cycle.

It is to be understood that the foregoing description of a preferred embodiment of the invention i provided for purposes of the description and illustration, and not as a measure of the invention, whose scope is to be defined by reference to the ensuing claims. Thus, while those skilled in the art may devise embodiments of the particular concepts presented in the foregoing illustrative disclosure which differs somewhat from the particular embodiment shown and described in detail herein, or may make various changes in structural details to the illustrated embodiment, all such alternative or modified embodiments which utilize the concepts of the invention and clearly incorporate the spirit thereof are to be considered as within the scope of the claims appended herebelow, unless such claims by their language specifically state otherwise.

The embodiments of the invention in which an exclusive property or privilege is claimed are defined as follows.

1. A dispenser for releasing additives in an automatic washer having a tub, a basket rotatably disposed within the tub, an agitator disposed within the basket for rotation about a common axis therewith, and a motor for rotatably driving said basket and agitator about said axis, said dispenser comprising:

a first receptacle adapted to contain a first predetermined quantity of additive;

means for coupling said first receptacle to the agitator for rotation therewith;

a second receptacle adapted to contain at least a second predetermined quantity of additive, said second receptacle being disposed at least partially below said first receptacle and including means for accumulating said second predetermined quantity of additive in said second receptacle from a plurality of lesser amounts transferred thereto being required;

first stage dispensing means for automatically dispensing successive portions of additive from said first receptacle and transferring such portions to said second receptacle after acceleration of said agitator to a rotational speed in excess of a first predetermined speed;

said portions of additive dispensed and transferred to said second receptacle being accumulated thereinto comprise said second predetermined quantity of additive only after said rotation of said agitator at a speed in excess of said first predetermined speed for a total period of time in excess of a particular predetermined period of time; and second stage dispensing means for automatically dispensing additive from said second receptacle after said second receptacle contains at least said second predetermined quantity of additive and after said first receptacle has decelerated from said first predetermined speed to a rotational speed less than a second predetermined such speed.

2. The dispenser of claim 1 wherein said first predetermined rotational speed is greater than the speed at which said agitator is driven during the wash cycle of said washer.

3. The dispenser of claim 1 wherein said second receptacle comprises a housing and said fist receptacle is fixedly disposed within the upper portion of said housing to rotate therewith when said agitator is rotated, said first stage dispensing means comprising an opening in said first receptacle of a size and location to pass additive from said first receptacle into said second receptacle when said first receptacle is rotated at a speed in excess of said first predetermined speed.

4. A dispenser for releasing additives in an automatic washer having a tub, a basket rotatably disposed within the tub, an agitator disposed within the basket for rotation about a common axis therewith, and a motor for rotatably driving said basket and agitator about said axis, said dispenser comprising:

a first receptacle adapted to contain a predetermined quantity of additive;

means for coupling said first receptacle to the agitator for rotation therewith;

a second receptacle adapted to contain at least said predetermined quantity of additive, said second receptacle being disposed at least partially below said first receptacle;

means for coupling said second receptacle to the agitator for rotation therewith;

first stage dispensing means for automatically dispensing portions of additive from said first receptacle and transferring such portion to said second receptacle after said agitator has been accelerated to a rotational speed in excess of a first predetermined speed, said first stage dispensing means moving a predetermined quantity of additive form said first receptacle into said second receptacle in response to and only after said rotation of said agitator at a speed in excess of said first predetermined speed for a total period of time in excess of a predetermined period of time;

second stage dispensing means for automatically dispensing additive from said second receptacle only after said second receptacle contains at least said predetermined quantity of additive and after said first receptacle has decelerated from said first predetermined speed to a rotational speed less than a second predetermined such speed;

said second stage dispensing means comprising:

siphon means disposed at least partially within said second receptacle and including a siphon channel having a first opening disposed within said second receptacle and a second opening disposed below the height of said first opening;

said siphon channel having an intermediate portion extending upwardly to a predetermined height above said first and second openings such that additive within said second receptacle remains unsiphoned until the level of such additive exceeds said predetermined height, at which time said siphon becomes primed and said additive is automatically drawn by siphon action through said channel and emitted from said second opening.

5. The dispenser of claim 4 wherein said siphon means comprises a tubular member disposed at least partially within said second receptacle, said tubular member being of generally inverted U-shape and having an upper portion disposed at said predetermined height.

6. The dispenser of claim 5 wherein said upper portion of said tubular member is generally arcuate in shape and is corrugated at said arcuate portion.

7. The dispenser of claim 5 wherein said tubular member has a portion between said upper portion and said second opening which is disposed substantially along the axis of rotation of said dispenser receptacle, such that when said second receptacle contains said predetermined quantity of said additive in said dispenser and said dispenser is rotated about said axis at a speed in excess of said second predetermined speed the height of the additive in said dispenser adjacent said upper portion remains below said predetermined height of said upper portion, and such that the height of the additive adjacent said upper portion reaches said predetermined height when said dispenser is decelerated to said second predetermined rotational speed.

8. The dispenser of claim 5 wherein said second receptacle comprises a cup having an inclined lower wall, said first opening into said siphon channel being disposed adjacent the lowermost portion of said inclined lower wall.

9. The dispenser of claim 5 wherein said second receptacle comprises:

a cup-like vessel having a bottom wall; and a downwardly extending recess formed in said lower wall, said first opening in said channel being disposed at least partially within said recess.

10. The dispenser of claim 5 wherein said second receptacle further comprises:

a lower wall; and a concavity formed in said lower wall, said first opening into said channel being disposed at least partially within said concavity.

11. The dispenser of claim 1 wherein at least one of said receptacles comprises a cup of generally frustoconical shape.

12. An additive dispenser for mounting to an agitator of an automatic washer having a tub, a basket rotatably disposed within the tub for rotation about an axis, an agitator disposed within the basket for rotation about said axis, and a motor for rotatably driving said basket and agitator about said rotational axis, said dispenser comprising:

a dispenser housing;

means for connecting said dispenser housing to the agitator for rotation therewith;

a first additive cup fixedly disposed within said dispenser housing and adapted to contain a predetermined quantity of additive;

a second additive cup fixedly disposed within said dispenser housing and adapted to contain at least said predetermined quantity of additive, said second cup being disposed at least partially below said first additive cup;

said first cup having an outlet at a location spaced from said rotation axis and positioned to pass additive from said first cup into said second cup when said dispenser housing and first cup are rotated at a speed in excess of a first predetermined angular speed; and siphon means disposed at least partially within said second receptacle and including a siphon channel having a first opening disposed within said second receptacle and a second opening disposed below the height of said first opening;

said siphon channel having an intermediate portion extending upwardly to a predetermined height above said first and second openings such that additive within said second receptacle remains unsiphoned until the level of such additive reaches said predetermined height, at which time said siphon becomes primed and said additive is automatically drawn by siphon action through said channel and emitted from said second opening.

13. The additive dispenser of claim 12 wherein said first predetermined angular speed is preselected to be less than the maximum spin speed of the washer, and wherein said first additive cup is configured and arranged to pass said predetermined quantity of additive into said second additive cup only after said dispenser has been rotated at a speed in excess of said first predetermined angular speed for an effective total period of time in excess of a predetermined period of time.

14. The additive dispenser of claim 12 wherein said siphon means is adapted to dispense additive from said second cup by siphon action only after said second cup contains at least said predetermined quantity of additive and after said second cup has decelerated to a rotational speed less than a second predetermined such speed.

15. The additive dispenser of claim 12 wherein said dispenser housing integrally defines said second cup and said first cup is fixedly disposed within the upper portion of said housing.

16. The additive dispenser of claim 12 wherein said first cup comprises an outer wall terminating in an upwardly directed peripheral edge, and wherein said outlet of said first cup comprises at least a portion of said peripheral edge.

17. The additive dispenser of claim 12 wherein said siphon means comprises a tubular member disposed at least partially within said second cup, said tubular member having an upper extremity disposed at said predetermined height.

18. The additive dispenser of claim 17 wherein said tubular member has a bend at said upper extremity and is corrugated at said bend.

19. The dispenser of claim 17 wherein said upper extremity of said tubular member-is disposed closely adjacent the axis of rotation of said dispenser, such that when said second cup contains said predetermined quantity of said additive and said dispenser is rotated at a speed in excess of said second predetermined speed the height of the additive in said second cup at said upper extremity remains below said predetermined height and such that the height of the additive near said upper extremity reaches said predetermined height when said dispenser is decelerated to said second predetermined angular speed.

20. A tub assembly for an automatic washer comprising:

a tub;

an agitator rotatably disposed within the tub for rotation about a rotational axis;

a first additive cup adapted to contain at least a predetermined quantity of additive, said first additive cup being mounted to said agitator for rotation therewith;

a second additive cup adapted to contain at least said predetermined quantity of additive, said second additive cup being disposed at least partially below said first additive cup;

first stage dispensing means for automatically dispensing portions of additive from said first cup to said second cup following rotation at an angular velocity in excess of a first predetermined angular velocity, said first stage dispensing means being configured and arranged to empty said predetermined quantity of additive from said first additive cup into said second additive cup only after having rotated at a speed for an effective total period of time in excess of a predetermined period of time; and second stage dispensing means for automatically dispensing additive from said second cup only after said second cup contains at least enough of said additive to reach a predetermined level in said second cup and after said first cup has decelerated to a rotational speed less than a second predetermined such speed.

21. The tub assembly of claim 20 further comprising means for automatically cleaning said second cup and said second stage dispensing means when said tub is at least partially filled with water.

22. The tub assembly of claim 21 wherein said means for automatically cleaning said second cup and said second stage dispensing means when said tub is at least partially filled with water comprises at least in part said second stage dispensing means.

23. The tub assembly of claim 20 wherein said second cup comprises a housing and said first cup is fixedly disposed within the upper portion of said housing to rotate therewith when said agitator is rotated, said first stage dispensing means comprising an opening into said first cup arranged and positioned to pass additive from said first cup into said second cup when said housing is rotated at a speed in excess of said first predetermined angular speed.

24. The tub assembly of claim 20 wherein said second stage dispensing means comprises siphon means disposed at least partially within said second cup and including a siphon channel having a first opening disposed within said second cup and a second opening disposed outside of said second cup and below the height of said first opening when said dispensing means is in position for use;

said siphon channel further including an intermediate portion extending upwardly to a predetermined height between and above said first and second openings, such that additive within said second cup remains therein until the level of such additive is at least that of said predetermined height, whereupon said additive is automatically drawn through said channel to said second opening by siphon action.

25. The tub assembly of claim 24 further comprising means for automatically cleaning said second cup and said second stage dispensing means when said tub is at least partially filled with water, said means for cleaning comprising said siphon channel, said water being drawn into said channel and second cup when said tub is filled to a height above said predetermined height and said water being drawn out of said second cup and siphon channel when said water is emptied from said tub.

* * * * *

UNITED STATES PATENT AND TRADEMARK OFFICE
CERTIFICATE OF CORRECTION

PATENT NO. : 5,033,277

DATED : July 23, 1991

INVENTOR(S) : Khan

It is certified that error appears in the above-identified patent and that said Letters Patent is hereby corrected as shown below:

Column 1, line 56:
"o" should be --or--.
Column 2, line 17:
Delete "stage" second occurrence.
Column 9, line 11:
After "is" delete --be--.
Column 9, line 24:
"i" should be --is--.
Column 10, Claim 3, line 17:
"fist" should be --first--.
Column 10, Claim 4, line 43:
"portion" should be --portions--.

Signed and Sealed this

Eighteenth Day of May, 1993

*Attest:*

Michael K. Kirk

MICHAEL K. KIRK

*Attesting Officer*

*Acting Commissioner of Patents and Trademarks*